United States Patent [19]

Ramachandran et al.

[11] 4,436,637

[45] Mar. 13, 1984

[54] FABRIC SOFTENING HEAVY DUTY LIQUID DETERGENT CONTAINING A MIXTURE OF WATER INSOLUBLE SOAP AND CLAY

[75] Inventors: Pallassana N. Ramachandran, Robbinsville; Kenneth S. Peterson, Keasbey, both of N.J.

[73] Assignee: Colgate-Palmolive Company, New York, N.Y.

[21] Appl. No.: 449,271

[22] Filed: Dec. 13, 1982

[51] Int. Cl.[3] ..... C11D 3/12; D06M 13/24

[52] U.S. Cl. ..... 252/8.7; 252/8.6; 252/135; 252/140; 252/174.25; 252/532; 252/534; 252/539; 252/551; 252/553; 252/558

[58] Field of Search ..... 252/8.7, 8.6, 8.75, 252/135, 140, 532, 534, 539, 551, 553, 558, 252/DIG. 14

[56] References Cited

U.S. PATENT DOCUMENTS

| | | | |
|---|---|---|---|
| 3,625,905 | 12/1971 | Weast | 252/109 |
| 3,989,631 | 11/1976 | Marsan | 252/8.6 |
| 4,025,444 | 5/1977 | Murphy et al. | 252/8.8 |
| 4,062,647 | 12/1977 | Storm et al. | 8/137 |
| 4,139,479 | 2/1979 | Goffinet et al. | 252/8.8 |

FOREIGN PATENT DOCUMENTS

| | | | |
|---|---|---|---|
| 55-50082 | 4/1980 | Japan | 252/8.6 |
| 56-72094 | 6/1981 | Japan | 252/174.25 |
| 1329416 | 9/1973 | United Kingdom . | |

*Primary Examiner*—P. E. Willis, Jr.

*Attorney, Agent, or Firm*—Bernard Lieberman; Herbert S. Sylvester; Murray M. Grill

[57] ABSTRACT

A fabric softening heavy duty liquid detergent, useful for both cleaning and softening laundry, includes synthetic organic detergent, preferably sodium higher alkylbenzene sulfonate, builder salt, preferably including sodium tripolyphosphate, finely divided swelling bentonite, water insoluble soap, and water. Such product is a stable pourable liquid, convenient for use in hand or machine washing of laundry. Preferably, the liquid detergent comprises about 9% of sodium linear tridecylbenzene sulfonate, about 2% of sodium alkyl polyethoxy sulfate wherein the alkyl is of 12 to 15 carbon atoms and the polyethoxy is of 3 ethylene oxide groups, about 11% of sodium tripolyphosphate, about 4% of sodium carbonate, about 12% of Wyoming bentonite, about 2% of aluminum stearate, about 1% of adjuvant(s), and about 59% of water.

8 Claims, No Drawings

FABRIC SOFTENING HEAVY DUTY LIQUID DETERGENT CONTAINING A MIXTURE OF WATER INSOLUBLE SOAP AND CLAY

This invention relates to a fabric softening heavy duty liquid detergent composition. More particularly, it relates to such a liquid detergent which comprises synthetic organic detergent and builder components together with a swelling bentonite and an insoluble soap in an aqueous medium. The product of the invention is of stable viscosity or thickness, is readily pourable and is a good detergent and fabric softener, which is capable of satisfactorily cleaning and softening laundry washed with it. Improved fabric softening action is attributable to the presence of the insoluble soap, which improves the softening power of the bentonite, especially in products for hand washing laundry.

Heavy duty liquid detergents, useful for machine washing of laundry, have been marketed and have been described in various patents and in the literature. Bentonite has been included in particulate detergent compositions as a fabric softener and has been utilized in aqueous compositions as a thickener, which can help to maintain insoluble particulate materials, such as abrasives, suspended in a liquid medium. Insoluble metal soaps, such as aluminum and calcium stearates, have been employed as lubricants and have been included in some detergent compositions because of their fabric softening effects. However, prior to the present invention it is not considered that bentonite was successfully employed in the manufacture of an acceptable stable heavy duty liquid detergent like that described in this application, which is of a relatively high proportion of bentonite, and in which the softening activity of the bentonite is significantly increased by a water insoluble metal soap which is also present in the liquid detergent composition.

In accordance with the present invention a fabric softening heavy duty liquid detergent comprises 5 to 20% of synthetic organic detergent selected from the group consisting of anionic, nonionic and amphoteric detergents, and mixtures thereof, 5 to 35% of builder salt, and mixtures thereof, 8 to 20% of a swelling bentonite, 0.5 to 10% of water insoluble metal soap, and 40 to 70% of water. Preferably, the present liquid detergent comprises 7 to 11% of sodium higher alkylbenzene sulfonate wherein the higher alkyl is of 12 to 13 carbon atoms, 1 to 3% of sodium alkyl polyethoxy sulfate wherein the alkyl is of 10 to 18 carbon atoms and the polyethoxy is of 3 to 11 ethylene oxide groups, 10 to 25% of builder salt selected from the group consisting of alkali metal tripolyphosphate, alkali metal carbonate, alkali metal bicarbonate, alkali metal sesquicarbonate, alkali metal silicate, alkali metal nitrilotriacetate, alkali metal citrate, alkali metal gluconate, borax, zeolite, and mixtures thereof, 10 to 15% of a swelling bentonite, 1 to 5% of water insoluble soap and 50 to 70% of water. The described liquid detergents, which are especially useful for hand washing cotton laundry, are commercially acceptable as heavy duty laundry detergents, capable of satisfactorily cleaning laundry items containing both oily and particulate soils and simultaneously depositing on such laundered items sufficient softening agent to appreciably soften them without making them objectionably chalky in appearance. Additionally, the described compositions may be employed for the pre-treatment of badly soiled areas, such as collars and cuffs, of items to be laundered.

Preferably detergents for use in the present compositions are the synthetic anionic detergents which are water soluble sulfates or sulfonates having lipophilic moieties containing higher alkyl groups. Of these it is preferred to employ a mixture of higher alkylbenzene sulfonate and alkyl polyethoxy sulfate. While other water soluble linear higher alkylbenzene sulfonates may also be present in the instant formulas, such as potassium salts and in some instances the ammonium or alkanolammonium salts, where appropriate, it has been found that the sodium salt is highly preferred, which is also in the case with respect to the alkyl polyethoxy sulfate detergent component. The alkylbenzene sulfonate is one wherein the higher alkyl is of 12 to 15 carbon atoms, preferably 12 or 13 carbon atoms. While the linear alkylbenzene sulfonates are preferred the branched alkyl compounds, such as the alkylbenzene sulfonates wherein the alkyl is propylene tetramer or pentamer, are also useful. The alkyl polyethoxy sulfate, which also may be referred to as a sulfated polyethoxylated higher linear alcohol or the sulfated concentration product of a higher fatty alcohol and ethylene oxide or polyethylene glycol, is one wherein the alkyl is of 10 to 18 carbon atoms, preferably 12 to 15 carbon atoms, e.g., about 13 carbon atoms, and which includes 3 to 11 ethylene oxide groups, preferably 3 to 7, more preferably 3 to 5 and most preferably 3 or about 3 ethylene oxide groups. Other anionic detergents, such as fatty alcohol sulfates, paraffin sulfonates, olefin sulfonates, monoglyceride sulfates, sarcosinates, sulfosuccinates and similarly functioning detergents, preferably as the alkali metal, e.g., sodium salts, may also be present, sometimes in replacement (usually partial replacement) of the previously mentioned synthetic organic detergents but often, if present, in addition to such detergents. Normally, the possibly supplementing detergents will be sulfated or sulfonated products (usually as the sodium salts) and will contain long chain (8 to 20 carbon atoms) linear or fatty alkyl groups. In addition to or in place of such anionic synthetic organic detergents, there also may be present nonionic and amphoteric materials, like the Neodols®, sold by Shell Chemical Company, which are condensation products of ethylene oxide and higher fatty alcohols, e.g., Neodol 23-6.5, which is a condensation product of a higher fatty alcohol of about 12 to 13 carbon atoms with about 6.5 mols of ethylene oxide. Also useful are the amphoteric detergents, such as the Miranols, e.g., Miranol C2M, which preferably will constitute only a part of the synthetic organic detergent content of the product. Illustrations of the various detergents and classes of detergents mentioned may be found in the text *Surface Active Agents,* Vol. II, by Schwartz, Perry and Berch (Interscience Publishers, 1958), especially pages 25 to 138, the descriptions of which are incorporated herein by reference.

The preferred builder salt combination of this invention, which has been found to satisfactorily improve detergency of the mixture of synthetic anionic organic detergents, produce the desired pH in the liquid detergent and in the wash water, and coact with the detergent and the bentonite in the washing and softening process, is a mixture of sodium tripolyphosphate and sodium carbonate. For best processing, easier mixing and good end-use properties it is preferred that the sodium tripolyphosphate be low in content of Phase I type tripolyphosphate. Thus, preferably the content of Phase I type tripolyphosphate will be less than 10% of the tripolyphosphate employed. Although in some instances incompletely neutralized tripolyphosphate may be used, normally the phosphate employed may be considered as being pentasodium tripolyphosphate, $Na_5P_3O_{10}$. Of course, in some instances, as when potassium salts of other materials are present, ion interchange in an aqueous medium may result in other salts than the sodium tripolyphosphate being present but for the purpose of this specification it will be considered that sodium tripolyphosphate, as the pentasodium salt, the material which is normally charged to the mixer to make the present liquid detergent, is the tripolyphosphate employed.

Other water soluble builder salts which may be used in place of sodium tripolyphosphate and sodium carbonate or in addition thereto include sodium citrate, potassium citrate, sodium nitrilotriacetate (NTA) (the corresponding potassium salt may be used in partial replacement), tetrasodium pyrophosphate, tetrapotassium pyrophosphate, sodium bicarbonate, sodium sesquicarbonate, sodium gluconate, borax, sodium silicate, and sodium sesquisilicate. Corresponding water soluble salts, such as other alkali metal salts may also be useful. Of course, various mixtures of the mentioned water soluble builder salts can be utilized. Yet, the tripolyphosphate-carbonate mixture described has been found to be most preferred, although the other builders and mixtures thereof are also operative, although usually to lesser extents. Among the water insoluble builders that may be used are the zeolites, such as Zeolite A, usually in the form of its crystalline hydrate, but some amorphous zeolites may also be useful. It is a feature of this invention that sodium silicate is not needed to make an effective heavy duty detergent-softener composition, although its presence is sometimes desirable, and therefore such silicate will usually be omitted from the present formulas when zeolite or other builder that is reactive with it, is present.

The bentonite employed is a colloidal clay (aluminum silicate) containing montmorillonite. The type of bentonite which is most useful in making the invented base beads is that which is known as sodium bentonite (or Wyoming or Western bentonite), which is normally of a light to cream color or may be a tannish impalpable powder which, in water, can form a colloidal suspension having strongly thixotropic properties. In many instances a potassium bentonite or a mixed sodium-potassium bentonite may be used instead. In water the swelling capacity of such clay will usually be in the range of 3 to 15 or 20 ml./gram, preferably 7 to 20 ml./g., and its viscosity, at 6% concentration in water, will usually be in the range of 3 to 30 centipoises, preferably 8 to 30 centipoises. Preferred swelling bentonites of this type are sold under the trade name Mineral Colloid, as industrial bentonites, by Benton Clay Company, an affiliate of Georgia Kaolin Co., and as Volclay by American Colloid Company. The Mineral Colloid clays, which are the same as those formerly sold under the trademark THIXO-JEL, are selectively mined and beneficiated bentonites, and those considered to be most useful are available as Mineral Colloid No's. 101, etc., corresponding to THIXO-JEL's No's. 1, 2, 3 and 4. Such materials have pH's (6% concentration in water) in the range of 8 to 9.4, maximum free moisture contents (before addition to the liquid detergent medium) of about 8% and specific gravities of about 2.6. For the pulverized grade of such materials at least about 85% will pass through a 200 mesh U.S. Sieve Series sieve. Preferably all the bentonite will pass through a 200 mesh sieve and most preferably all of it will pass through a No. 325 sieve, so that the equivalent diameter of the bentonite may be considered as being less than 74 microns and more preferably less than 44 microns. Also useful are the American Colloid Company General Purpose Bentonite Powder and their Special Purpose Powder, such as their bentonite designated AEG-325. Western or Wyoming bentonites are preferred as a component of the present liquid detergent compositions but other bentonites, including the synthetic bentonites (those made from bentonites having exchangeable calcium and/or magnesium, by sodium carbonate treatment) are also useful and are intended to be included in compositions of this invention. Preferred swelling bentonites of the synthetic types described are sold under the trade names Laviosa and Winkelmann, e.g., Laviosa AGB and Winkelmann G 13. Other clays that may be used, often only in partial replacement of the other preferred and mentioned bentonites, include those sold under the trade names: Brock, Volclay BC; Gel White GP; Ben-A-Gel; Veegum F; Laponite SP; and Barasym LIH 200. Typical chemical analyses of the bentonites that are useful for making the present liquid detergents show that they contain from 62 to 73.0% of $SiO_2$, 14 to 22% of $Al_2O_3$, 1.6 to 2.9% of MgO, 0.5 to 3.1% of CaO, 2.3 to 3.5% of $Fe_2O_3$, 0.8 to 2.8% of $Na_2O$ and 0.4 to 7.0% of $K_2O$.

Employment of bentonite as the softening agent in the present liquid detergent compositions has the advantage that the bentonite does not have to be dried, as in a spray dryer, and therefore the risk of losing the softening power of the bentonite, due to immobilization of the plates thereof by overdrying, is avoided. Also, it is unnecessary to have the detergent composition of such formula specially formulated and treated to promote quick disintegration of the detergent bead in the wash water to release the bentonite particles because in the liquid detergent such particles are not agglomerated into hard masses which could require additional time for disintegration.

The water insoluble soaps useful to make the products of this invention are those of 8 to 20 carbon atoms, preferably 10 or 12 to 18 carbon atoms and most preferably of 18 carbon atoms and saturated. Among such soaps are the octoates, decanoates, laurates, myristates, palmitates, oleates (unsaturated) and stearates of aluminum, calcium, magnesium, barium and zinc, and mixtures thereof. Such soaps are usually made by either the fusion method or the precipitation method. In the former of these an appropriate metallic oxide, hydroxide, or salt of a weak acid is reacted directly with the selected fatty acid at an elevated temperature. In the precipitation method a dilute soluble soap solution is first prepared by reacting caustic soda with the selected fatty acid and it is then reacted with a separately prepared salt solution of the desired metal to cause precipitation of the metallic soap. The described soaps, which are normally finely enough divided so that substantially all thereof passes through a No. 200 sieve (U.S. Sieve Series) and in many cases substantially all, e.g., over 95 or 99%, passes through a No. 325 sieve. However, in appropriate circumstances somewhat coarser powders may also be useful, such as those which pass through a No. 100 sieve, but generally the finer the powder the better. Such soaps will normally contain very small proportions, if any, of water soluble salts or moisture and all of them will be powdered solids at room temperature. All of the mentioned soaps are white so they will not adversely affect the appearance of the detergent composition. In fact, they may help to improve the color of the bentonite, which, although nominally white, sometimes tends to appear tannish or creamy. It is noted that the various aluminum soaps may have higher free fatty acid contents than those of calcium, magnesium, barium and zinc, with free fatty acid percentages ranging from 2 to about 30%. However, such does not interfere with functioning of such materials in the present invented compositions and processes. With respect to the aluminum soaps one may employ the di- or tri- salt, e.g., aluminum distearate, aluminum tristearate, but it is considered that a mixture of such soaps is preferable, wherein the proportions will be in the range of 1:3 to 3:1, e.g., about 1:1. Other incompletely reacted insoluble soaps of the other mentioned metals (and aluminum) and of other di- and polyvalent metals, and completely reacted soaps thereof may be employed in various proportions, and mixtures of the various soaps may also be used.

The various mentioned water insoluble soaps are described in a bulletin entitled *Witco Metallic Stearates, Their Properties and Uses,* dated September 1974 and published by Witco Chemical Corporation, New York, N.Y. 10017, which is incorporated herein by reference.

The only other required component of the present liquid detergents is water. Normally the hardness content of such water will be less than about 300 p.p.m., as $CaCO_3$, and preferably it will be less than 150 p.p.m. Often it may be desirable to utilize deionized water although often city water with less than 50 or 100 p.p.m. hardness content will be about as satisfactory. While harder waters may be successfully employed in making the present liquid detergents it is considered that soft waters have less likelihood of producing some objectionable materials which could adversely affect the appearance of the liquid detergent or which could deposit objectionably on laundry during washing.

Various adjuvants may be present in the liquid detergents, such as fluorescent brighteners, perfumes and colorants. The fluorescent brighteners include the well known stilbene derivatives, including the cotton and nylon brighteners, such as those sold under the trademark Tinopal (5BM Conc.). The perfumes that are employed usually include essential oils, esters, aldehydes and/or alcohols, all of which are known in the perfumery art. The colorants may include dyes and water dispersible pigments of various types, including ultramarine blue. Because of the lightening effect due to the presence of the bentonite in the liquid detergent, colors of the product may often be attractive pastels. Titanium dioxide may be utilized to lighten the color of the product further or to whiten it. Inorganic filler salts, such as sodium sulfate and sodium chloride may be present, as may be antiredeposition agents, such as sodium carboxymethylcellulose; dispersing agents, such as sodium polyacrylate; enzymes; bleaches; bactericides; fungicides; anti-foam agents, such as silicones; anti-soiling agents, such as copolyesters; preservatives, such as formalin; foam stabilizers, such as lauric myristic diethanolamide; and auxiliary solvents, such as ethanol. Normally the individual proportions of such adjuvants will be less than 3%, often less than 1% and sometimes even less than 0.5%, except for any fillers and solvents, and additional detergents and builders for which the proportions may sometimes be as high as 10%. The total proportion of adjuvants, will normally be no more than 20% of the product and desirably will be less than 10% thereof, more desirably less than 5% thereof. Of course, the adjuvants employed will be non-interfering with the washing and softening actions of the liquid detergent and will not promote instability of the product on standing. Also, they will not cause the production of objectionable deposits on the laundry.

The proportions of the various components in the present liquid detergent will be within the range of 5 to 20% of detergent, preferably 7 to 15% of anionic detergent, and more preferably 9 to 13% thereof, with such proportions being 5 to 15%, preferably 7 to 11% and more preferably about 9% of the sodium linear higher alkylbenzene sulfonate and 1 to 5%, preferably 1 to 3% and more preferably about 2% of the sodium alkylpolyethoxy sulfate, when such combination of anionic detergents is employed; 5 to 35%, preferably 10 to 25% and more preferably about 15% of builder salt; 8 to 20%, preferably 10 to 15% and more preferably about 12% of swelling bentonite; 0.5 to 10%, preferably 1 to 5% and more preferably about 2% of water insoluble metal soap; and 40 to 70%, preferably 50 to 70% and more preferably 55 to 65%, e.g., 60%, of water. Of the builder salts, when they are sodium tripolyphosphate and sodium carbonate, the proportions thereof will usually be 5 to 20%, preferably 10 to 17% and more preferably about 11% of the tripolyphosphate; and 1 to 10%, preferably 2 to 7%, and more preferably about 4% of sodium carbonate; with the ratio of tripolyphosphate to carbonate preferably being within the range of 2:1 to 6:1.

The liquid detergents may be made by appropriately mixing the various components thereof, preferably with the bentonite and insoluble soap or a mixture thereof being added near the end of the process. Thus, for example, the anionic detergent may be admixed with the water, after which the polyphosphate and carbonate, in finely divided form, normally sufficiently fine to pass a No. 160 screen, may be added, followed by any adjuvants and the bentonite and insoluble soap. However, when the liquid detergent is made by this procedure or by other procedures in which the bentonite is added earlier the mix tends to become at least temporarily thickened more than is desirable. On standing the mix will thin somewhat but this requires additional processing time. It has been found that if a portion of the water is held out and is post-added to the rest of the liquid detergent it will quickly effect a thinning of the detergent to the desired apparent viscosity.

The viscosity of the present liquid detergent is normally in the range of about 5 to 100 centipoises, preferably 10 to 70 cp., e.g., 40 cp., but products of other suitable viscosities may also be useful. It should be kept in mind that the liquid detergent made, apparently largely due to the presence of the bentonite and insoluble soap combination therein, is thixotropic and therefore viscosity figures are to be interpreted accordingly. At the viscosities mentioned the liquid detergent is pourable, stable, non-separating and uniform. Such is somewhat surprising and is attributable to the combination described, the components of which appear to interact to produce the desirably stable, yet freely pourable detergent. Also, the pH of the liquid detergent suspension, usually in the range of 8 to 11.5, preferably 9 to 10.8, appears to help to maintain product stability and pourability. Aqueous bentonite suspensions in water at the concentrations utilized in the present liquid detergent can sometimes produce thick gels which are not pourable and it appears that the mixture of anionic detergent, such as the linear alkylbenzene sulfonate with ethoxylated alcohol sulfate, and the described builders helps to keep the bentonite in the aqueous medium from gelling excessively.

Experience has shown that the desirable proportion of water to hold back and admix last in the manufacturing process is normally 5 to 20% of the final liquid detergent, preferably 8 to 12%, e.g., about 10% thereof. During the mixing of the various components with the aqueous medium, and especially when the bentonite and insoluble soap are added and the remaining water is admixed, it is important to maintain the mixture in motion, as by continuing to mix or stir it. Preferably, the mixer is never turned off and the process is continuous, normally taking about 3 to 30 minutes, preferably 5 to 10 minutes per batch. While the water may be warmed to promote dissolving of the various product components therein and to promote dispersing of the bentonite and the insoluble soap such is not necessary and room temperature water, e.g., water at a temperature in the range of 15° to 30° C., such as 20° to 25° C., may be used.

The following examples illustrate but do not limit the invention. Unless otherwise indicated all parts are by weight and all temperatures are in °C.

EXAMPLE 1

| Components | Percent |
|---|---|
| Sodium linear tridecylbenzene sulfonate | 9.0 |
| Sodium alkyl polyethoxy sulfate (alkyl = fatty alkyl of 12 to 15 carbon atoms; polyethoxy = 3 ethoxy groups) | 2.2 |
| Pentasodium tripolyphosphate (10% or less of Phase 1) | 11.0 |
| Sodium carbonate (anhydrous) | 4.0 |
| Bentonite (Mineral Colloid 101) | 12.0 |
| Insoluble soap (Aluminum Stearate #18 - Witco Chemical Corp.) | 2.0 |
| Fluorescent brightener (Tinopal 5BM Conc.) | 0.3 |
| Perfume | 0.3 |
| Colorant (ultramarine blue or FD&C dye solution) | 0.2 |
| Water (city water of about 50 p.p.m. of hardness as calcium carbonate | 59.0 |
| | 100.0 |

49 Parts of water are added to a suitable mixer, such as a vertical cylindrical tank equipped with heating and cooling means and connected to a discharge pump, the synthetic organic detergents are added, with stirring (by a Lightnin type mixer), and the polyphosphate and carbonate builder salts (of particle sizes that pass a No. 160 sieve) are admixed, with the phosphate being added first, after which the fluorescent brightener and colorant are admixed. Mixing of the batch, which weighs about 500 kilograms, takes about four minutes. Then, the insoluble soap and the swelling bentonite, both in finely divided powder form, substantially all passing through a No. 200 screen (U.S. Sieve Series) and over 90% passing through a No. 325 screen, are admixed with the mixture, which results in the viscosity thereof being raised higher than desired. The balance of the water is added and the perfume is then admixed and the product is ready to be pumped out of the mixer and into end use containers. During the mixing operation, all of which takes about nine minutes, the materials added and the final product are at a temperature of about 20° C. In some cases, to promote faster dissolving and quicker dispersing of the components, the temperature of the water charged may be raised to 40° to 50° C. so that the final product temperature may be about 30° to 40° C., in which case the mixing time may be reduced to about 5 or 6 minutes. The liquid detergent resulting (at room temperature) has a viscosity of about 50 cp. and pours satisfactorily from a plastic detergent bottle with a discharge opening of about 2.5 cm. It has a pH of about 10.6. It is of an attractive light blue uniform appearance and on storage does not settle into different layers of materials. After storage it is still readily pourable but if for any reason it should become too thick it can be made pourable by shaking, or flexing of the plastic (polyethylene or polypropylene) container. Still, shaking is not necessary to make sure that the composition is uniform.

The liquid detergent made is tested for detergency by hand washing towels pre-soiled with clay and sebum soils at a concentration of 3.5 g./l. in water of about 100 p.p.m. hardness, as $CaCO_3$. The product is an excellent detergent, cleaning and whitening the soiled towels and removing from them the deposited soils. Apparently, no anti-redeposition agent is needed to prevent objectionable redeposition of the soil and the clay soil is satisfactorily removed despite the presence of bentonite in the product. This was not surprising, in view of experience with bentonite-containing liquid detergents, such as those described in a U.S. patent application of Pallassana N. Ramachandran, one of the present inventors, and Paul S. Grand, entitled Fabric Softening Heavy Duty Liquid Detergent and Process for Manufacture thereof, which is being filed the same day as the present application. However, what is surprising is that in a hand washing test, wherein towels are hand washed in cold water (21° C.) of ordinary city water hardness (100 p.p.m., as $CaCO_3$), really excellent softening effects are obtainable with the compositions of this invention. Thus, when cotton hand towels are washed in such cold water containing 3.5 g./l. concentration of the present liquid detergent, after which the towels are rinsed in fresh water and line dried, an expert evaluator rates them close to perfect in softness, awarding them a rating of 9 on a scale of 10. Although some bentonite-containing compositions have achieved the rating of 8 when employed for hand washing, a rating of 9 is very difficult to obtain and is considered to be an unexpected benefit of the employment of insoluble soap with bentonite in the present detergent compositions. Towels washed with a control formula, in which both the bentonite and insoluble soap were omitted from the formula and were replaced by water, are evaluated to have a softness rated at only 1 whereas similar towels washed with a bentonite-containing liquid detergent, wherein only the insoluble soap is replaced by water, are rated at 8, using the same test.

The reason for the unexpected improvement in the softening activity of the invented composition is not clear. It has been theorized that bentonite is less active as a softening agent when employed in hand washing of laundry because a "straining" effect, which may be present when the wash water is drained from the laundry in a washing machine, is not obtained during hand washing and therefore not as much bentonite will be drawn through and held to the laundry. According to this theory the insoluble soap helps to attract the bentonite to the fibers of laundry fabrics and thereby increases the deposition of the bentonite on the fabrics, leading to increased softening. Although this theory appears to be valid, it is understood that applicants are not bound by it and it has no limiting effect on the present invention.

The liquid detergent is also used as a pre-treatment for soiled areas of laundry, to which it is applied full strength (although dilutions may also be used). The liquid detergent is rubbed into the soiled areas and during the rubbing the bentonite apparently assists in loosening and removing the soil and at the same time tends to adhere to the fibers of the material of the laundry, thus helping to soften it better, especially at such locations. Such softening may contribute to lesser soiling of the area in the future, especially when the soiled areas are shirt cuffs or collars.

In variations of the above formula the alkylbenzene sulfonate is replaced by branched chain sodium dodecylbenzene sulfonate, the tripolyphosphate is replaced by tetrapotassium pyrophosphate, the sodium carbonate is replaced by sodium sesquicarbonate and the aluminum stearate is replaced in turn by each of calcium stearate, magnesium stearate, barium stearate, zinc stearate, aluminum palmitate, calcium myristate, barium laurate and zinc oleate, and 1:1 mixtures of aluminum stearate and calcium stearate, and of aluminum hydrogenated tallow soap and calcium coconut oil soap. The products are good "softergents" and the insoluble soaps have a softness increasing effect on the bentonite for hand washing, which is further increased when the proportions of such soaps are doubled. Also, when the proportion of bentonite is increased to about 15% and the proportion of insoluble soap is doubled to 4%, with the water content being decreased accordingly, further improved softening results when the liquid detergent is employed in the hand washing of cotton and other fabrics. Excellent softening also results when in any of the formulations mentioned the concentration of the liquid detergent in the hand washing wash water is within the range of 0.1 to 1%, preferably being from 0.3 to 0.7%. While the present liquid detergents are especially useful in cold water washing of laundry they are also good detergent-softeners (or "softergents") in warm water and in waters of hardness in the 0 to 300 p.p.m. range.

In other variations of the above formula the sodium alkyl polyethoxy sulfate may be replaced by a higher fatty alcohol polyethylene oxide condensation product, such as Neodol 23-6.5, and a useful fabric softening liquid detergent is also obtainable.

EXAMPLE 2

A liquid detergent like that of Example 1 is made but only 2% of sodium carbonate is employed in the formulation, with the water content being increased correspondingly. Although the sodium carbonate content is decreased the mix is still processable to a final product of desirable properties, which is useful as a heavy duty laundry detergent for hand washing cotton and synthetic materials and softening them, and is also useful as a pre-treatment for such laundry.

In other variations of this embodiment of the invention, when the proportions of the various components are changed ±10% or ±20%, without going outside the ranges given in this specification, stable, pourable liquid detergents of useful cleaning and softening effects result. In some such products it may be desirable to include as much as 10% of Zeolite A or up to 5% of sodium silicate of $Na_2O:SiO_2$ ratio of about 1:2.4, although the silicate will often be avoided, and if the zeolite is present, to avoid depositing of zeolite-silicate aggregates or reaction products, the silicate will normally be omitted. If thinning of the liquid is desired up to 10% of ethanol or isopropanol may be employed.

EXAMPLE 3

A liquid detergent like that of Example 1 is formulated using a linear dodecylbenzene sulfonate in place of the linear tridecylbenzene sulfonate, sodium alkyl polyethoxy sulfate wherein the alkyl is of 12 to 13 carbon atoms and the polyethoxy is of an average of 6.5 ethoxy groups, instead of that previously employed, 12% of the STPP, 6% of sodium carbonate, 15% of bentonite, the adjuvants previously mentioned and 53% of water. The additional sodium carbonate improves the miscibility of the various components during the manufacturing procedure and the replacement of the detergents does not significantly adversely affect the properties of the product. The product is made in essentially the same manner as previously described.

The liquid detergent is a stable pourable liquid having the desirable cleaning and softening properties described for the liquid detergent of Example 1, whether used for machine washing or hand washing of laundry, or for pre-treatments thereof, but it is especially useful for cleaning and softening hand washed laundry.

Similarly, acceptable liquid detergents are made when 3% of sodium lauryl alcohol sulfate, 2% of Neodol 23-6.5 and 0.5% of silicone anti-foam oil are incorporated in the product by addition to the components of Example 1 (replacing water). Also when sodium citrate or potassium citrate is employed to replace the sodium carbonate (or when only partial replacements of such materials, e.g., 30% replacements, are effected with such citrates or trisodium nitrilotriacetate) useful liquid detergents result, having properties like those of the compositions previously described.

Instead of employing the 2% of aluminum stearate, as in Example 1, the aluminum stearate may be made in situ by utilizing stoichiometric proportions of aluminum chloride and sodium stearate and in some cases the sodium stearate may be present in excess. The liquid detergent so made will have similar highly desirable fabric softening properties when utilized in the hand washing of laundry, especially laundry including cotton fabrics.

As is seen from the preceding description and the working examples, the fabric softening heavy duty liquid detergents of this invention are stable, uniform, attractive and functional. Despite the presence of a substantial proportion of gelling agent (bentonite) and insoluble soap in a liquid medium, they do not form objectionable gels and they remain pourable during storage. Also, despite lengthy storage, during which the suspended bentonite and insoluble soap are subjected to intimate contact with surface active agents and inorganic salt builders in an aqueous medium there is no objectionable agglomeration and the softening action of the product on laundry is not destroyed. Despite the relatively high content of bentonite of the swelling type (and insoluble soap), the product remains liquid and pourable and retains its physical and chemical characteristics which allow it to be deposited on the laundry and act as a lubricant for the fibers thereof, thereby promoting softening of such laundry. Also, as was previously mentioned, by employment of the liquid medium the possibility that the bentonite would be deactivated by overheating, as in a spray drying tower, is obviated.

The present liquid detergents, in addition to being useful as products for machine and hand washing of laundry, are also good for pre-treatments of stained portions of laundry, in which treatments it is considered that the bentonite and insoluble soap content assist in removing the stains and in softening the stained area (and the product is also subsequently employed for washing purposes). Thus, from the foregoing recitation of the properties and advantages of the present invention it is seen that it represents a significant advance in the detergent composition art because it allows convenient employment of a liquid detergent to both clean and soften laundry during hand washing (and to pretreat it) while utilizing excellent anionic synthetic organic detergents and not having to incorporate with them adversely chemically reactive cationic materials, such as quaternary ammonium salts. Furthermore, the bentonites and insoluble soaps of aluminum, calcium and magnesium employed are not ecologically harmful, as the quaternary ammonium salts might be, and do not cause buildups of objectionable fatty deposits on laundry, which often can cause it to look discolored, as the quaternaries sometimes do.

While the sodium salts and sodium compounds of the various components of the present liquid detergents have been described because they are especially satisfactory and are commercially available, the corresponding potassium compounds may be substituted for them, at least in part, and are also within this invention. Thus, potassium detergents, potassium builder salts, potassium bentonites and potassium adjuvant salts can be used and such are intended to be included with sodium compounds as "alkali metal" compounds.

The invention has been described with respect to various embodiments and working examples but is not to be limited to these because it is evident that one of skill in the art, with the present specification before him, will be able to utilize substitutes and equivalents without departing from the invention.

What is claimed is:

1. A fabric softening heavy duty liquid detergent which comprises 5 to 20% of synthetic organic detergent selected from the group consisting of anionic, nonionic and amphoteric detergents, and mixtures thereof, 5 to 35% of builder salt, and mixtures thereof, 8 to 20% of a swelling bentonite, 0.5 to 10% of water insoluble metal soap, and 40 to 70% of water.

2. A liquid detergent according to claim 1 wherein the detergent is an anionic detergent, the builder salt includes a phosphate and the water insoluble soap is a higher fatty acid soap of a metal selected from the group consisting of aluminum, calcium, magnesium, barium and zinc.

3. A liquid detergent according to claim 2 wherein the water insoluble soap is an aluminum soap.

4. A liquid detergent according to claim 2 comprising 5 to 15% of alkali metal higher alkylbenzene sulfonate wherein the higher alkyl is of 12 to 15 carbon atoms, 1 to 5% of alkali metal alkyl polyethoxy sulfate wherein the alkyl is of 10 to 18 carbon atoms and the polyethoxy is of 3 to 11 ethylene oxide groups, 5 to 35% of a total of alkali metal tripolyphosphate and alkali metal carbonate builder salts, with the ratio of tripolyphosphate to carbonate being in the range of 2:1 to 6:1, 8 to 20% of a swelling bentonite, 0.5 to 10% of water insoluble soap, and 40 to 70% of water.

5. A liquid detergent according to claim 4 wherein the alkali metal is sodium.

6. A liquid detergent according to claim 5 wherein the sodium linear higher alkylbenzene sulfonate is sodium linear tridecylbenzene sulfonate, the sodium alkyl polyethoxy sulfate is one wherein the alkyl is of 12 to 15 carbon atoms and the polyethoxy is of 3 to 7 ethylene oxide groups, and the swelling bentonite is a sodium bentonite.

7. A liquid detergent according to claim 6 comprising 7 to 11% of sodium linear tridecylbenzene sulfonate, 1 to 3% of sodium alkyl polyethoxy sulfate wherein the alkyl is of 12 to 15 carbon atoms and the polyethoxy is of about 3 ethylene oxide groups, 10 to 17% of sodium tripolyphosphate containing less than 10% thereof of Phase I type tripolyphosphate, 2 to 7% of sodium carbonate, 10 to 15% of sodium bentonite of particle sizes less than 44 microns, 1 to 5% of aluminum soap, and 50 to 70% of water.

8. A liquid detergent according to claim 7 comprising about 9% of sodium linear tridecylbenzene sulfonate, about 2% of sodium alkyl polyethoxy sulfate wherein the alkyl is of 12 to 15 carbon atoms and the polyethoxy is of 3 ethylene oxide groups, about 11% of sodium tripolyphosphate, about 4% of sodium carbonate, about 12% of Wyoming bentonite, about 2% of aluminum stearate, which is a mixture of the distearate and tristearate, and about 60% of water.

* * * * *

UNITED STATES PATENT AND TRADEMARK OFFICE

CERTIFICATE OF CORRECTION

PATENT NO. : 4,436,637

DATED : March 13, 1984

INVENTOR(S) : Pallassana N. Ramachandran and Kenneth S. Peterson

It is certified that error appears in the above-identified patent and that said Letters Patent are hereby corrected as shown below:

Title page, column 2, at the seventh line of the Abstract, delete "stable pourable";

Col. 1, line 12, delete;

Col. 1, line 32, replace "an acceptable stable" with --- a ---;

Col. 1, lines 61, 62, delete "commercially acceptable";

Col. 2, line 13, delete "in";

Col. 2, line 23, replace "concentration" with --- condensation ---;

Col. 3, lines 42, 43, delete "in making the invented base beads";

Col. 4, line 59, delete ", which";

Col. 6, lines 51-54, delete;

Col. 6, line 55, replace "mind that the" with --- The ---;

Col. 6, line 57, replace "and therefore viscos-" with --- , ---;

Col. 6, lines 58, 59, delete;

Col. 6, line 60, delete "stable, non-separating";

UNITED STATES PATENT AND TRADEMARK OFFICE

CERTIFICATE OF CORRECTION

PATENT NO. : 4,436,637

DATED : March 13, 1984

INVENTOR(S) : Pallassana N. Ramachandran and Kenneth S. Peterson

It is certified that error appears in the above-identified patent and that said Letters Patent are hereby corrected as shown below:

Col. 6, line 63, delete "desirably stable, yet freely";
Col. 6, line 66, delete "stability and";
Col. 7, line 44, after "carbonate" insert --- ) ---;
Col. 8, line 6, delete "has a viscosity of about 50 cp. and";
Col. 8, line 11, delete "readily";
Col. 10, line 12, after "bentonite" insert --- , ---;
Col. 10, line 20, delete "stable";
Col. 10, line 26, delete "acceptable";
Col. 10, line 48, delete "stable,";
Col. 10, lines 52, 53, delete "and they remain pourable during storage";
Col. 10, line 58, delete "Despite the";
Col. 10, lines 59, 60, replace with "The product"; and
Col. 10, line 61, delete "pourable and".

Signed and Sealed this

*Nineteenth* Day of *November 1985*

[SEAL]

*Attest:*

*Attesting Officer*

DONALD J. QUIGG

*Commissioner of Patents and Trademarks*